US007903042B2

(12) United States Patent
Urban et al.

(10) Patent No.: US 7,903,042 B2
(45) Date of Patent: Mar. 8, 2011

(54) ANTENNA ARRANGEMENT AND WINDOW FITTED WITH THIS ANTENNA ARRANGEMENT

(75) Inventors: Thomas Urban, Heilbronn (DE); Helmut Maeuser, Herzogenrath (DE); Gunther Vortmeier, Herzogenrath (DE); Detlev Duerkop, Huerth (DE)

(73) Assignee: Saint-Gobain Glass France, Courbevoie (FR)

( * ) Notice: Subject to any disclaimer, the term of this patent is extended or adjusted under 35 U.S.C. 154(b) by 802 days.

(21) Appl. No.: 10/578,179

(22) PCT Filed: Nov. 4, 2004

(86) PCT No.: PCT/FR2004/050563

§ 371 (c)(1),
(2), (4) Date: Feb. 20, 2007

(87) PCT Pub. No.: WO2005/045987

PCT Pub. Date: May 19, 2005

(65) Prior Publication Data

US 2008/0024379 A1 Jan. 31, 2008

(30) Foreign Application Priority Data

Nov. 4, 2003 (DE) ..... 103 51 488
Jan. 31, 2004 (DE) ..... 20 2004 001 446 U

(51) Int. Cl.
*H01Q 21/26* (2006.01)

(52) U.S. Cl. ..... 343/797; 343/700 MS

(58) Field of Classification Search ..... 343/700 MS, 343/793, 795, 797
See application file for complete search history.

(56) References Cited

U.S. PATENT DOCUMENTS

| | | | | |
|---|---|---|---|---|
| 3,299,430 | A | 1/1967 | Huber et al. | |
| 3,599,214 | A | 8/1971 | Altmayer | |
| 4,746,925 | A | 5/1988 | Toriyama | |
| 5,068,670 | A * | 11/1991 | Maoz | 343/767 |
| 5,293,175 | A | 3/1994 | Hemmie et al. | |
| 5,363,114 | A * | 11/1994 | Shoemaker | 343/828 |
| 6,054,961 | A | 4/2000 | Gong et al. | |

(Continued)

FOREIGN PATENT DOCUMENTS

| | | |
|---|---|---|
| EP | 0 920 074 A1 | 6/1999 |
| EP | 1 229 605 A1 | 8/2002 |

OTHER PUBLICATIONS

Robert E. Canright, Jr., "A Simple Formula for Dual Stripline Characteristic Impedance", Southeastcon '90. Proceedings., IEEE, vol. 3, (Session 10A5), Apr. 1-4, 1990, pp. 903-905.

(Continued)

*Primary Examiner* — HoangAnh T Le
(74) *Attorney, Agent, or Firm* — Oblon, Spivak, McClelland, Maier & Neustadt, L.L.P.

(57) ABSTRACT

An antenna arrangement for transmitting and receiving electromagnetic signals includes a flat carrier substrate made of a dielectric material, a first conducting track applied to a surface of the carrier substrate, a second conducting track applied to an other surface of the carrier substrate. The first conducting track includes at one end a point of contact to gather or inject signals and a first dipole at the opposite end. The second conducting track includes at one end a point of contact to gather or inject the signals and a second dipole at the opposite end. The first and the second dipoles form a crossed dipole. The antenna arrangement may be disposed on a glazing.

39 Claims, 3 Drawing Sheets

U.S. PATENT DOCUMENTS

| | | | | |
|---|---|---|---|---|
| 6,163,306 | A * | 12/2000 | Nakamura et al. | 343/797 |
| 6,281,854 | B1 | 8/2001 | Ohoka et al. | |
| 6,339,406 | B1 * | 1/2002 | Nesic et al. | 343/797 |
| 6,343,867 | B1 * | 2/2002 | Suzuki et al. | 362/610 |
| 2003/0034926 | A1 * | 2/2003 | Veerasamy | 343/713 |
| 2004/0056805 | A1 | 3/2004 | Chen | |

OTHER PUBLICATIONS

Mikavica, M. et al., "A Novel Broadband Printed Antenna Element", Mediterranean Electrotechnical Conference, vol. 1, pp. 256-259, 1998.

* cited by examiner

ANTENNA ARRANGEMENT AND WINDOW FITTED WITH THIS ANTENNA ARRANGEMENT

BACKGROUND OF THE INVENTION

I. Field of the Invention

The invention pertains to an antenna arrangement for transmitting and receiving electromagnetic signals as well as to glazings furnished with such antenna arrangements.

II. Description of Related Art

The receiving and transmitting of electromagnetic waves call particularly upon crossed-dipole antennas. Such an antenna is known, for example, from Patent DE 699 05 436 T2. The drawback of this crossed-dipole antenna resides in the fact that it exhibits an excessive height for certain applications.

If a small height is necessary, the antennas used in the art of high frequencies are frequently so-called patch antennas with which the antenna proper is composed of a patch. With such antennas, the patch and the feed cable have to frequently exhibit the same layered structure, which amounts to saying that the material of the substrate and the height of the substrate are identical for the supply cable and the patch. In this case it is difficult to find a good compromise between the requirements imposed on the feed cable, it should neither transmit nor receive, and on the antenna itself, it should transmit or receive as well as possible.

In the technical field of traffic flow, devices which demand wireless communication are being employed more and more often. Communication applications of this type are, for example, centralized traffic guidance or electronic toll collection (ETC). The frequency used for these applications is generally of the order of 5.8 GHz (microwave frequencies). The antennas for these frequencies are also called DSRC antennas (standing for Dedicated Short Range Communication). In the field of ETC, an onboard DSRC unit (OBU On-Board Unit) for motor vehicles is known from U.S. Pat. No. 6,421,017 B1. This OBU comprises an antenna and a control unit for communication with transmitter/receiver devices that are disposed along the path travelled. The innovation according to the above American patent resides in the fact that the OBU is modified in such a way that it can be installed on the dashboard at a given distance from the windscreen. This makes it possible to avoid the characteristics of the antenna being too dispersed on account of the various gaps between the antenna and the glazing following inaccurate mounting. The drawback with this arrangement is that the location of mounting of the OBU is not variable. Another drawback appears when a glazing has to be covered with a layer reflecting electromagnetic waves. In this case, data transmission is possible only if a corresponding communication window is provided in the coating. The manufacture of such a communication window is however frequently tied to increased complexity and increased cost.

BRIEF SUMMARY OF THE INVENTION

An object of the invention is to provide an antenna arrangement which exhibits small outside dimensions and which may be mounted without difficulty in a given position.

Accordingly, the present invention firstly proposes an antenna arrangement for transmitting and receiving electromagnetic signals, the antenna arrangement comprising:

a flat carrier substrate made of dielectric material, a first conducting track applied to a surface of the carrier substrate, the first conducting track possessing at one end a point of contact so as to gather thereat or inject thereat the signals and a first dipole at the opposite end, a second conducting track applied to the other surface of the carrier substrate, the second conducting track possessing at one end a point of contact so as to gather thereat or inject thereat the signals and a second dipole at the opposite end, and the first and the second dipoles forming a crossed dipole.

According to the invention, the antenna arrangement is thus composed of a flat substrate that does not conduct electricity, for example a film, on the main surfaces of which are disposed two conducting bands that act as signal lines.

One of the ends of each of them is configured so as to be able to establish a link with another electronic component or with another signal line.

The other corresponding end of the conducting bands terminates as two folded parts that form the poles of a dipole.

On account of its configuration, the antenna is globally very flat.

The dipoles that are derived from the two conducting bands are in perpendicular projection with respect to one another so as to form a crossed dipole.

The two poles of each dipole are preferably perpendicular to one another and the two dipoles themselves are preferably pivoted by 180° with respect to one another.

Furthermore, if the support or substrate used is a film, the antenna arrangement is additionally flexible. This considerably simplifies mounting on, in or against a carrier structure.

The dimensions of the conducting sections that constitute the structure of the antenna are matched in a known manner to the frequency of operation and to the passband of the global system by integrating the surrounding medium.

To match the impedances or the characteristic impedances of the dipole and of the conducting bands, it is preferable to use a so-called $\lambda/4$ transformer between the antenna zone proper and the part of the conducting band which gets linked to the dipole and which serves for the transmission of the signal. The $\lambda/4$ transformer is a section of conducting band whose characteristic impedance is adjusted so as to be able to obtain transmission with the least possible losses of the signals received or transmitted in the conducting bands which are linked thereto. The characteristic impedances are thus matched to one another. The $\lambda/4$ transformer itself and the conducting band that gets linked thereto are embodied in the form of a so-called strip line which is characterized in that the conducting bands disposed on the opposite faces of the carrier substrate coincide. The strip line is thus a bipolar line comprising conducting bands which coincide and are preferably spaced close together.

The line losses in the conducting bands disposed the one on the other of the two sides of the substrate may be reduced if the sections of the two conducting bands used only for the carriage of the signal exhibit different widths, this amounting to saying that a so-called microband line is produced. The longitudinal axes of the two conducting bands here run parallel and preferably coincide. The electromagnetic field produced between the conducting bands is then limited in its dimensions in such a way as to decrease a radiation.

It is preferable for the transition between the strip line and the conducting bands that get linked thereto and serve only for the transmission of the signal (microband line for example) not to be made abruptly with a jump in the width of the conductor. Preferably, a transition line with gradual adaptation of the width is made so as to avoid unwanted reflections and thus signal nulling and damping. The gradual transition is generally effected with an adaptation element often called a "taper balun", or else may also be for example a wide section of trapezoidal form.

In certain cases, it may turn out to be judicious to shield the conducting tracks, that is to say to protect the signal transmission pathways against the influence of the electromagnetic radiation acting from the outside. This shielding may be obtained, for example, via additional bands of electrically conducting material above and below the conductor of the signal proper. These additional conducting tracks are of course galvanically insulated from the signal conductors. This insulation may be achieved by means of an intermediate layer of the same dielectric substrate which acts as support or by other measures, for example by providing an intermediate layer of insulating varnish. The shielding lines may be earthed to improve the performance of the shielding.

Copper has proved its worth as material for the conducting tracks, on the one hand because it possesses a good conductivity and on the other hand because it is easy to implement. It is quite obviously possible to use other appropriate conducting materials, for example metals such as tin, silver or gold.

The electrical insulating support may be composed of polyimide, for example, this material is also frequently used as support for flat cables. It is however, also possible to use any other appropriate material, as long as it exhibits the necessary properties, in particular good dielectric properties, perhaps the possibility of being implemented in the form of a film and the possibility of applying conducting structures thereto.

The transmission of signals at high frequency may give rise to relatively severe line losses and/or losses by radiation, thereby making it necessary for the link lines connected to the antenna arrangement to be designed for the corresponding application so that the losses are minimal. If it is necessary to have an interface if possible universal or standardized between the antenna arrangement and a processing apparatus such as an OBU installed some distance from this arrangement, the high-frequency signal signals may then, in accordance with the invention, already be converted into a baseband, that is to say into signals of lower-frequency signal, with the aid of an electronic circuit in immediate proximity to or on the antenna arrangement itself. These may be conveyed to the processing apparatus with low losses, even over great distances.

The said electronic circuit may be composed of discrete and/or integrated electronic components (IC), for example according to DE 198 56 663 C2 or DE 101 29 664 C2. The state of the art makes it possible to fabricate such electronic circuits in a very flat form so that they may be mounted without additional provisions on a thin and/or flexible carrier substrate (for example according to DE 100 02 777 C1). In addition to the frequency converter, the electronic circuit may also contain an amplifier, a tuner and/or other processing elements.

The flat antenna structure according to the invention is particularly suitable for mounting on glazings of buildings or of vehicles. Specifically, on account of its flat form, the antenna arrangement in accordance with the invention may be applied very discreetly to a flat object such as a glazing.

The flexible antenna structure in the case of the use of a flexible film is particularly suitable for mounting on glazings of buildings or of vehicles. Specifically, its flexible structure allows it also to be mounted without difficultly on a curved glazing. The antenna arrangement according to the invention can in particular be easily glued.

The glazings used may be monolithic, that is to say composed of a single pane, or also multilayer, composed of several panes and/or films. The panes may be essentially transparent, made of glass or plastic, be flat or curved. A pane may be furnished with one or more films, two panes or more may be joined together by means of an adhesive layer or an adhesive film.

By virtue of the above-described properties, the antenna arrangement may easily be glued to a main surface of a glazing.

In the case of multilayer structures, for example when using a laminated glass glazing, the flat antenna arrangement in its entirety or in part may also be disposed inside the sandwich structure.

The carrier substrate zone furnished with the points of contact may protrude laterally from the sandwich structure and possibly be folded around the lateral edge of the glazing. Linking to an additional signal line or to passive or active electrical networks is thus easy to achieve.

In a first embodiment of the invention with a multilayer or monolithic glazing, the zone of the antenna arrangement with the dipoles is mounted on one of the free main surfaces of the glazing, the zone of the antenna arrangement with the points of contact intended to gather and/or to inject the signals is mounted on the other main surface of the glazing, and the carrier substrate is passed around the peripheral surface of the glazing.

In a second embodiment of the invention using a multilayer glazing, the zone of the antenna arrangement with the dipoles is disposed between two of the layers of the glazing, the zone of the antenna arrangement with the points of contact intended to gather and/or to inject the signals is mounted on one of the two free main surfaces of the glazing and the carrier substrate is passed around the peripheral surface of at least one of the layers of the glazing.

When the carrier substrate is passed around a lateral edge of the glazing, it may turn out to be advantageous to furnish the peripheral edge of the monolithic pane or, in the case of a sandwich pane structure, of one or more individual panes in this zone with a recess or with a hollow (see for example Patent EP 0 593 940 B1).

This makes it possible to guarantee that the carrier substrate does not overstep the initial contour of the glazing. Damage during transport or during handling may thus be avoided and fitting into a frame or the mounting of a frame are considerably facilitated. Such an execution with a peripheral edge with recess is particularly appropriate when the carrier substrate bears components whose cross section is larger than that of the conducting tracks and of the dipoles, for example an electronic circuit for frequency matching or for adaptation to a linking connector. These components may then be disposed while being particularly protected in the hollow formed on the peripheral edge where they are less exposed than in the case of mounting on the surface of the pane. After the mounting of the carrier substrate is terminated, these components may be moulded with an appropriate sealing mass with the aid of which the said hollow may subsequently be levelled on the surface.

If a glazing is furnished with a layer or with a coating which reflects electromagnetic waves but which is optically transparent, it is nevertheless necessary to take care that the antenna arrangement is not shielded by this layer or this coating. The layer or the coating must therefore not be disposed between the antenna arrangement and the transmitter or the receiver of the antenna signals. In the converse case, the layer or the coating must comprise a zone that allows waves to pass through (communication window). Quite obviously, neither should there be provision for any layer or coating reflecting electromagnetic waves between the two dipoles.

Also in a preferred embodiment, whether the glazing be monolithic or layered, the zone of the antenna arrangement containing the dipoles is disposed so as to transmit or receive the electromagnetic signals correctly, said zone being disposed further towards the outside than the said reflecting layer after mounting of the glazing for example on a car.

The said layers or the said coatings reflecting electromagnetic waves serve, for example, for thermal insulation or may act as surface heating.

A particular advantage of the invention resides in the fact that if the antenna arrangement is fixed on or against a glazing or at the very least the zone containing the dipoles, it is not necessary to adapt or treat a coating which reflects electromagnetic waves that may be present and oriented further towards the inside after mounting of the glazing for example on a car.

When the glazing is a multilayer pane, the zone of the antenna arrangement containing the dipoles may be disposed between the reflecting coating or layer and the internal face of the external layer of the glazing, that is to say the layer intended to be outermost.

When the glazing is a monolithic pane the zone of the antenna arrangement containing the dipoles may be disposed between the reflecting coating or layer and the internal face of the pane.

When the antenna arrangement in accordance with the invention is mounted in or against a glazing, it may be protected by a layer of opaque or translucent paint on one of the panes or one of the films so that it cannot be seen from the outside. This protection may be applied for aesthetic reasons, but also to protect certain materials against ultraviolet rays.

Other features and advantages of the subject of the invention result, without restriction, from the drawings of the exemplary embodiments and the detailed description hereinbelow.

BRIEF DESCRIPTION OF THE DRAWINGS

The simplified representation, not to scale, illustrates

DETAILED DESCRIPTION OF THE INVENTION

Figure 1:
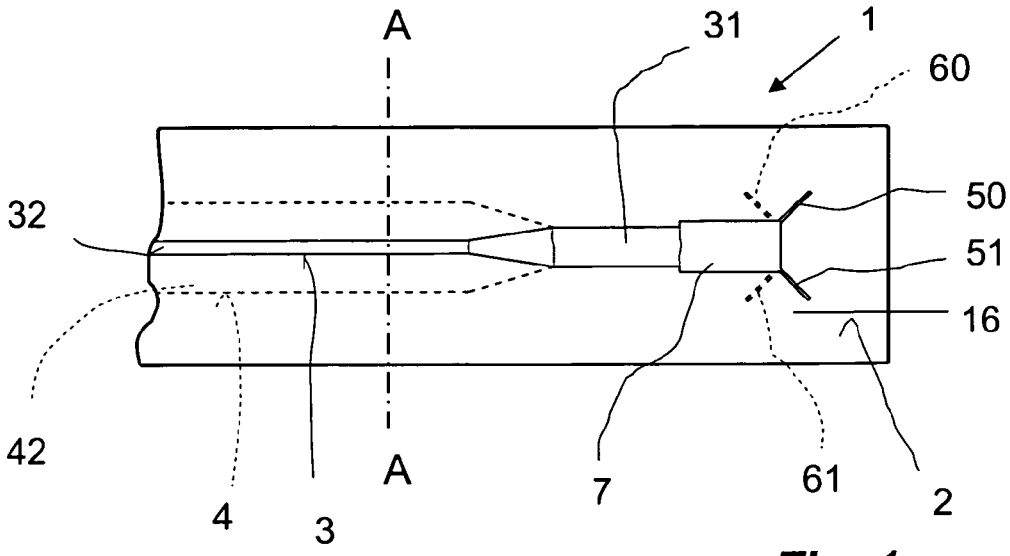
FIG. 1 a first embodiment of an antenna arrangement in the form of a film, viewed from above.
Figure 2:
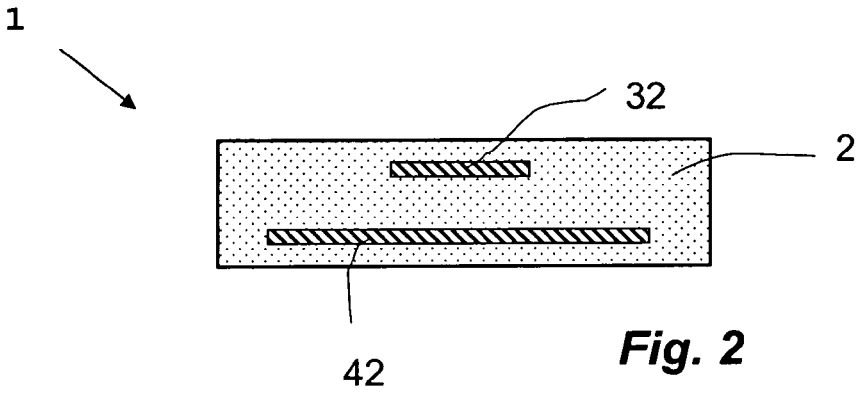
FIG. 2 a sectional cut along the line A-A of the embodiment according to FIG. 1.

According to FIG. 1 and FIG. 2, the antenna arrangement 1 is composed of a flexible carrier film 2 made of polyimide and partially transparent in which are integrated electrically conducting bands 3 and 4 made of copper. The carrier film 2 is around 30 mm wide and 150 μm thick. The integrated conducting bands are around 17 μm thick and are spaced around 100 μm apart.

Two conducting sections that act as poles 50 and 51 or 60 and 61 run respectively from one end of the conducting bands 3 and 4. The poles 50 and 51 on one side and 60 and 61 (shown dashed) on the other, electrically connected, respectively form an antenna dipole. An angle of 135° is formed between the poles 50 and 51 and the lateral limits of the conducting band 3. The poles 60 and 61 and the lateral limits of the conducting band 4 (shown dashed), on the other hand, form an angle of 45°. The poles 50, 51 on one side and 60 and 61 on the other side thus form respectively a right angle between them, whereas the two dipoles 50/51 and 60/61 formed do not coincide, but are pivoted by 180° with respect to one another.

In the representation of FIG. 1, the bases of the two dipoles 50/51 and 60/61 coincide with one another and form an X in the direction of the vertical projection. Other overlaps are conceivable, however, by shifting the bases with respect to one another. In an extreme case, it is a diamond which is formed in the vertical projection.

For simplifying reasons, the zone of the antenna arrangement opposite from the zone 16 which exhibits the dipoles 50/51 and 60/61 is not represented here. Elements intended to connect the conducting bands 3 and 4 with an antenna cable or with an electronic circuit are provided thereat so as to gather thereat and/or to inject thereat the signals transported. The elements of this type form part of the state of the art and will therefore not be the subject of a more detailed description here.

The conducting section attached directly to the dipoles 50/51 and 60/61 is embodied in the form of a so-called $\lambda/4$ transformer which matches the impedances of the dipoles to the impedance of the coincident conducting bands, embodied in the form of a strip line 31. Only the upper line part of the $\lambda/4$ transformer 7 and the strip line 31 of the conducting band 3 are visible in FIG. 1, the corresponding components to be associated with the conducting band 4 are covered in this representation.

The zones 32 and 42 of the conducting bands 3 and 4, which lead to the elements for linking at the opposite end from the dipoles of the carrier film, possess different widths and form a so-called microband line. In the arrangement of the global system, this type of line turns out to exhibit a lower attenuation than that of the strip lines or of the other types of lines. The losses by damping are considerably reduced. The transition between the asymmetric zones 32, 42 of the conducting bands and the symmetric strip line 31 is effected gradually so as to reduce or eliminate unwanted reflections, dampings at the level of the line and thus fadings of the signals transported.

Figure 3:
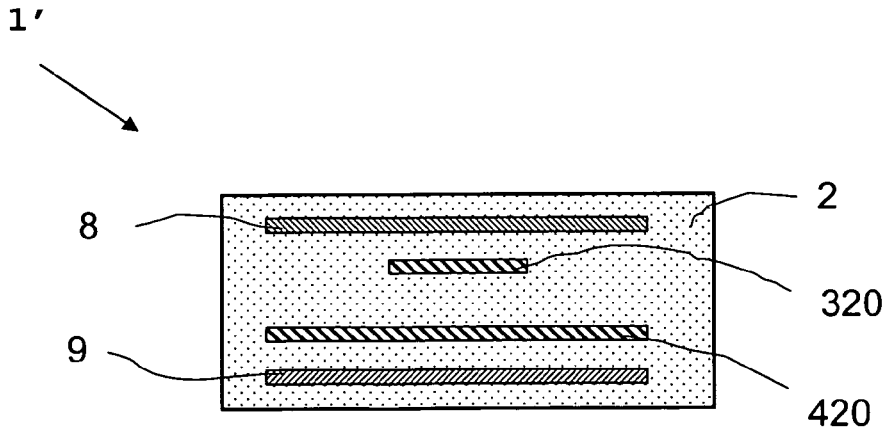
FIG. 3 a sectional view of a second embodiment of an antenna arrangement in the form of a film with shielding lines.

FIG. 3 represents a second embodiment of the antenna arrangement 1' in accordance with the invention. As in FIG. 2, FIG. 3 represents a section through the zone of the conducting bands 320 and 420 that are asymmetric in width. Shielding bands 8 and 9 are however disposed here in addition above the conducting band 320 and below the conducting band 420 and integrated into the substrate 2. The shielding bands 8 and 9 are earthed or connected to the earth terminal and contribute to improved shielding of the conducting bands 320 and 420 which transmit the signals. The unwanted signals acting from the outside may thus effectively be stopped.

In the exemplary embodiments represented, the electrically conducting components of the antenna arrangement (conducting bands 3, 4, 32, 42, 320 and 420 as well as the shielding bands 8 and 9) are always embodied completely integrated into the carrier substrate. Quite obviously, this is not absolutely necessary in particular if these electrically conducting elements are not in contact with other conducting elements (metal wires, heating wires, etc.). Such is the case in particular when the antenna arrangement in accordance with the invention is integrated into another component, for example a laminated glazing. Also, the electrically conducting components of the antenna arrangement (conducting bands 3, 4, 32, 42, 320 and 420) or, as appropriate, the shielding bands 8 and 9, may be on the free surface of a carrier substrate, and may in addition be covered with a lacquer, in particular an insulating lacquer.

When it is indicated, in the above descriptions of the figures, that the conducting bands 3, 4, 32, 42, 320 and 420 as well as the shielding bands 8 and 9 are "integrated", this should not restrict either the method of fabrication (for example by coextrusion), or the structure of the antenna arrangement on a monoblock carrier substrate. Even if the carrier substrate 2 is always represented in the form of a single body in the drawings, it may also consist of several films or panes disposed one above the other. These (partial) carrier substrates then each represent one or more conducting bands or else they serve solely for insulation. Thus, the arrangement may comprise an alternation of conducting layers (3, 4, 32, 42, 320 and 420 as well as the shielding bands 8 and 9) and of insulating layers.

The conducting and shielding bands 3, 4, 32, 42, 320, 420, 8 and 9 may be fabricated from films or metal braids or else be applied directly to a (partial) carrier substrate by screen printing. Likewise, the known methods of etching of the printed circuits technique may be used for the fabrication of the conducting and shielding bands.

Figure 4:
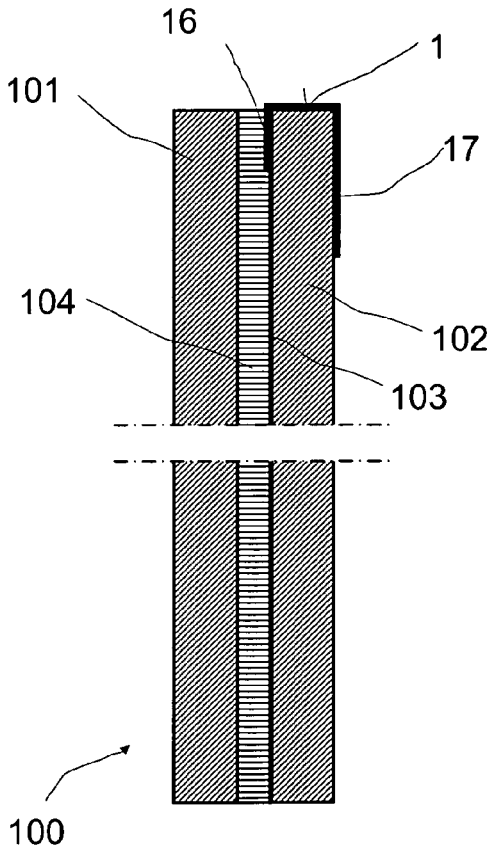
FIG. 4 a sectional view of a glazing comprising the antenna arrangement of FIG. 1.

FIG. 4 is a schematic view (which is not to scale) of a transverse section through a glazing comprising the antenna arrangement of FIG. 1.

This glazing 100 is laminated and comprises, a glass sheet 101 intended to be the external sheet after mounting of the glazing in a building or a car, an insert 104, preferably of PVB a glass sheet 102 (internal sheet)

a layer reflecting electromagnetic waves covering the "external" face (PVB side) of the internal sheet 102 and disposed directly on this sheet—or alternatively on PET—.

The zone 16 of the antenna arrangement with the dipoles is disposed at the rim of the external face of the internal sheet 102, and above a part of the reflecting layer 104. The arrangement 1 wraps around the peripheral edge of this internal sheet 102 as it folds and the zone 17 of the antenna arrangement with the points of contact runs over the internal face of the internal sheet.

Figure 5:
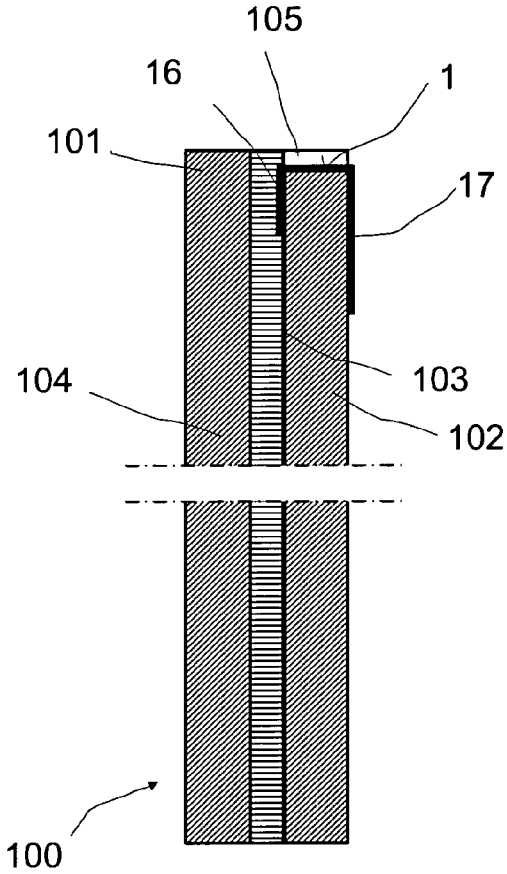
FIG. 5 a sectional view of a glazing comprising the antenna arrangement of FIG. 1, in a variant of FIG. 4.

In a variant shown in FIG. 5, the peripheral edge of the internal sheet 102 is furnished with a recess 105. This makes it possible to guarantee that the carrier substrate does not overstep the initial contour of the sheet 102. Damage during transport or during handling may thus be avoided and fitting into a frame or the mounting of a frame are considerably facilitated.

Figure 6:
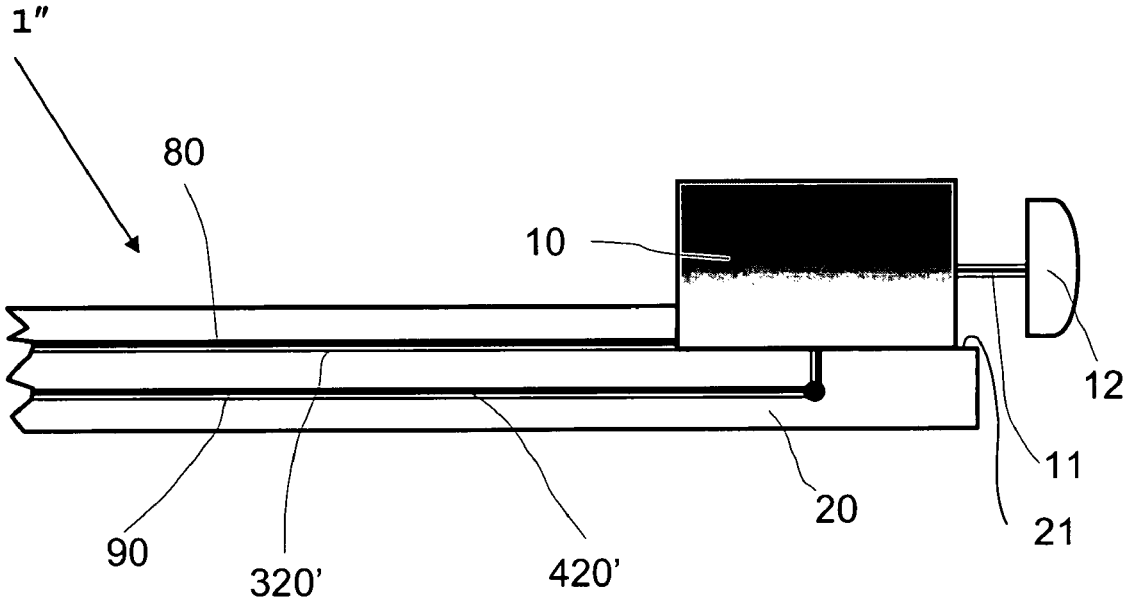
FIG. 6 a longitudinal sectional view of a third embodiment of an antenna arrangement according to the invention.

FIG. 6 shows a schematic longitudinal sectional view of a third embodiment of an antenna arrangement 1" according to the invention.

Only the differences with respect to the second embodiment (FIG. 3) are described hereinafter in greater detail.

The conducting tracks 320', 420' are disposed between the shielding lines 80, 90 these conducting layers 320', 420', 80, 90 being wholly integrated into a carrier substrate in the form of a flexible film 20 with a peripheral edge with recess 21.

The antenna arrangement 1" furthermore comprises an electronic adaptation circuit for frequency matching 10 disposed in this zone of the recess 21 and is linked to a connector 11 itself ending up on an adapter connector 12. In this way, the high-frequency signal signals are converted into a baseband, that is to say into signals of lower-frequency signal.

The said electronic circuit may be composed of discrete and/or integrated electronic components (IC), for example according to DE 198 56 663 C2 or DE 101 29 664 C2. It is possible by preference to choose a very flat shape so that they can be mounted without additional provisions on the carrier substrate. In addition to the frequency converter, the electronic circuit can also contain an amplifier, a tuner and/or other processing elements.

The zone with this circuit 10 may be disposed while being particularly protected in a recess or a hollow formed on a peripheral edge of a laminated or monolithic glazing where it is less exposed than in the case of mounting on the surface of the glazing. After the mounting of the carrier substrate has terminated, this component may be moulded with an appropriate sealing mass with the aid of which the said hollow may subsequently be levelled at the surface.

The invention claimed is:

1. A glazing, comprising:

a substantially transparent monolithic pane; and an antenna arrangement that transmits and receives electromagnetic signals and is disposed on the glazing, the antenna arrangement comprising:

a flat carrier substrate made of a dielectric material;

a first conducting track applied to the carrier substrate, the first conducting track including at one end a point of contact to gather or inject the signals and a first dipole at an opposite end; and a second conducting track applied to the carrier substrate opposite from a first surface of the carrier substrate, the second conducting track including at one end a point of contact to gather or inject the signals and a second dipole at an opposite end, wherein the first and the second dipoles form crossed dipoles, a portion of the antenna arrangement including the dipoles is mounted on one of the outer surfaces of the glazing, a portion of the antenna arrangement including points of contact to gather or to inject the signals is mounted on an other surface of the glazing, and the carrier substrate is disposed around a peripheral surface of the glazing.

2. The glazing according to claim 1, wherein a $\lambda/4$ transformer is disposed between the dipoles and the conducting tracks.

3. The glazing according to claim 2, wherein the $\lambda/4$ transformer is in the form of a strip line.

4. The glazing according to claim 3, wherein the conducting tracks between the transformer and the one end have different widths.

5. The glazing according to claim 4, wherein a transition line with a gradual adaptation of the width is disposed between the conducting tracks and the transformer.

6. The glazing according to claim 5, wherein the conducting tracks between the one end and the transition line have a constant width.

7. The glazing according to claim 1, wherein a conducting track acting as a shielding line is disposed both above the first conducting track and below the second conducting track.

8. The glazing according to claim 7, wherein the conducting tracks and the dipoles are integrated in the substrate.

9. The glazing according to claim 1, wherein the conducting tracks are made of copper.

10. The glazing according to claim 1, wherein the carrier substrate is a flexible film.

11. The glazing according to claim 1, wherein an electronic circuit to convert high-frequency signal signals into lower-frequency signal signals is disposed on the carrier substrate.

12. The glazing according to claim 1, wherein the glazing includes a coating or a layer that reflects electromagnetic waves, and a portion of the antenna arrangement including the dipoles is disposed on an outside of the coating or layer.

13. The glazing according to claim 1, wherein the peripheral surface of the glazing, in the portion contacting the carrier substrate, includes a recess with respect to a continuous edge of the peripheral surface.

14. The glazing according to claim 13, wherein circuit components disposed on the carrier substrate are housed while being protected in the recess.

15. The glazing according to claim 13, wherein the recess is filled with a sealing mass.

16. The glazing according to claim 1, wherein the first and the second dipoles are perpendicular to one another.

17. The glazing according to claim 1, wherein the substrate includes a plurality films or panes disposed one above another.

18. The glazing according to claim 1, wherein the carrier substrate is a flexible film made of polyimide.

19. A glazing, comprising:

a substantially transparent multilayer pane; and an antenna arrangement, that transmits and receives electromagnetic signals and is disposed on the glazing, the antenna arrangement comprising:

a flat carrier substrate made of a dielectric material;

a first conducting track applied to the carrier substrate, the first conducting track including at one end a point of contact to gather or inject the signals and a first dipole at an opposite end; and a second conducting track applied to the carrier substrate opposite from a first surface of the carrier substrate, the second conducting track including at one end a point of contact to gather or inject the signals and a second dipole at an opposite end, wherein the first and the second dipoles form crossed dipoles a portion of the antenna arrangement including the dipoles is disposed between two of the layers of the glazing, a portion of the antenna arrangement including the points of contact to gather or to inject the signals is mounted on one of the two outer surfaces of the glazing, and the carrier substrate is disposed around a peripheral surface of at least one of the layers of the glazing.

20. The glazing according to claim 19, wherein the glazing includes a coating or a layer that reflects electromagnetic waves and a portion of the antenna arrangement including the dipoles is disposed on an outside of the coating or layer.

21. The glazing including the antenna arrangement according to claim 19, wherein the glazing is a substantially transparent multilayer pane and at least a part of the antenna arrangement is disposed between two layers of the glazing.

22. The glazing including the antenna arrangement according to claim 19, wherein the glazing is a substantially transparent multilayer pane including a coating or a layer reflecting electromagnetic waves and a portion of the antenna arrangement including the dipoles is disposed between the coating or the reflecting layer and an internal face of an outermost layer of the glazing.

23. The glazing according to claim 19, wherein a $\lambda/4$ transformer is disposed between the dipoles and the conducting tracks.

24. The glazing according to claim 23, wherein the $\lambda/4$ transformer is in the form of a strip line.

25. The glazing according to claim 24, wherein the conducting tracks between the transformer and the one end have different widths.

26. The glazing according to claim 25, wherein a transition line with a gradual adaptation of the width is disposed between the conducting tracks and the transformer.

27. The glazing according to claim 26, wherein the conducting tracks between the one end and the transition line have a constant width.

28. The glazing according to claim 19, wherein a conducting track acting as a shielding line is disposed both above the first conducting track and below the second conducting track.

29. The glazing according to claim 28, wherein the conducting tracks and the dipoles are integrated in the substrate.

30. The glazing according to claim 19, wherein the conducting tracks are made of copper.

31. The glazing according to claim 19, wherein the carrier substrate is a flexible film.

32. The glazing according to claim 19, wherein an electronic circuit to convert high-frequency signal signals into lower-frequency signal signals is disposed on the carrier substrate.

33. The glazing according to claim 19, wherein a portion of the antenna arrangement including the dipoles is mounted on one of the outer surfaces of the glazing, a portion of the antenna arrangement including points of contact to gather or to inject the signals is mounted on an other outer surface of the glazing, and the carrier substrate is disposed around a peripheral surface of the glazing.

34. The glazing according to claim 19, wherein the peripheral surface of the glazing, in the portion contacting the carrier substrate, includes a recess with respect to a continuous edge of the peripheral surface.

35. The glazing according to claim 34, wherein circuit components disposed on the carrier substrate are housed while being protected in the recess.

36. The glazing according to claim 34, wherein the recess is filled with a sealing mass.

37. The glazing according to claim 19, wherein the first and the second dipoles are perpendicular to one another.

38. The glazing according to claim 19, wherein the substrate includes a plurality films or panes disposed one above another.

39. The glazing according to claim 19, wherein the carrier substrate is a flexible film made of polyimide.

* * * * *